US005707694A

United States Patent [19]

Beardsley et al.

[11] Patent Number: 5,707,694

[45] Date of Patent: Jan. 13, 1998

[54] PROCESS FOR REDUCING OXYGEN CONTENT IN THERMALLY SPRAYED METAL COATINGS

[75] Inventors: M. Brad Beardsley, Laura; Gary L. Biltgen, Peoria, both of Ill.

[73] Assignee: Caterpillar Inc., Peoria, Ill.

[21] Appl. No.: 657,857

[22] Filed: May 31, 1996

[51] Int. Cl.[6] ..... C23C 4/06

[52] U.S. Cl. ..... 427/450; 427/446; 427/451; 427/455; 427/456

[58] Field of Search ..... 427/450, 451, 427/446, 455, 456, 216

[56] References Cited

U.S. PATENT DOCUMENTS

| | | | |
|---|---|---|---|
| 4,121,083 | 10/1978 | Smyth | 427/446 |
| 5,144,110 | 9/1992 | Marantz et al. | 427/446 |
| 5,372,845 | 12/1994 | Rangawamu et al. | 427/453 |

OTHER PUBLICATIONS

"Sprayforming by High–Power High–Velocity Plasma Spraying", Scholl et al., Fourth National Spray Conference, Pittsburgh, May 1991.

*Primary Examiner*—Katherine A. Bareford

*Attorney, Agent, or Firm*—Pankaj M. Khosla

[57] ABSTRACT

A method for reducing oxygen content in metal coatings deposited by gas stabilized plasma spray techniques comprises the following steps. A metal powder is provided. Carbon is adhered and coated to the metal powder and a carbon coated metal powder is formed. A primary gas is provided to a plasma spray gun at a flow rate in the range of about 30–80 liter/min. A carrier gas is also provided to the plasma spray gun at a flow rate in the range of about 4–8 liter/min. The carbon coated metal powder is provided to the plasma gun at a flow rate in the range of about 30–85 gms/min. The plasma spray gun is positioned at a stand-off distance in the range of about 100–175 mm from a substrate. The plasma spray gun is energized with power in the range of about 28–42 kW. The carbon coated metal powder is sprayed onto the substrate and a metal coating having an oxygen content at least 20% by weight less than an oxygen content of the metal powder, is deposited.

17 Claims, No Drawings

PROCESS FOR REDUCING OXYGEN CONTENT IN THERMALLY SPRAYED METAL COATINGS

TECHNICAL FIELD

The present invention relates generally to methods for reducing oxygen in metal coatings, and more particularly to a method for reducing oxygen content in metal coatings which are deposited by gas stabilized plasma spray techniques.

BACKGROUND ART

Thermal spray techniques are used to deposit wear resistant or thermally insulating coatings from metal and/or ceramic powders, on various components. For example, ceramic powders are thermally sprayed on the face of engine piston crowns and valves to deposit thermal barrier coatings on these components. In other instances, metal powders are thermally sprayed on various engine components to alter the thermal conductivity and/or wear characteristics of such components.

Metal coatings deposited by thermal spray techniques, such as plasma spray for example, generally have a high oxygen content when compared to the oxygen content in the wrought metal. It is important to reduce the amount of oxygen present in the metal coating in order to improve the formability of the coating, to make the coating less brittle and to improve corrosion resistance.

Various methods for reducing the oxygen content in thermally sprayed metal coatings are known to those skilled in the art. One such method is to thermally spray the metal powder in a chamber filled with an inert gas, such as nitrogen, for example. Another method is to use an inert gas shroud to protect the molten powder from oxidation during the thermal spray process.

One common problem encountered in the thermal spray process is the susceptibility of the sprayed metal powder to oxidation. This problem becomes more severe when one uses metal powders that have been prepared by water atomization methods. Commercially available water atomized metal powders are about half the cost of gas atomized metal powders and hence the use of gas atomized metal powders represents a waste of labor and resources. However, water atomized metal powders contain about five to ten times greater oxygen than gas atomized metal powders. Typically, water atomized metal powders contain about 10,000 ppm to about 20,000 ppm of oxygen by weight whereas gas atomized metal powders contain 100 ppm to 500 ppm oxygen by weight. Even water atomized metal powders that have been annealed contain about 1,000 ppm to 5,000 ppm oxygen by weight.

None of the heretofore mentioned thermal spray methods facilitate the lowering of oxygen content in the sprayed metal coating to ultra-low levels, such as equal to or less than 500 ppm, or 0.05% oxygen by weight. A technical article titled "Sprayforming by High-Power High-Velocity Plasma Spraying" by M. Scholl, P. Clayton, E. Elmore and J. Wooten, published in the proceedings of the Fourth National Thermal Spray Conference, Pittsburgh, Pa., U.S.A., May 4–10 1991, pages 281–288 further illustrates this problem. In that technical publication, the authors reported the problem of a six-fold increase in the oxygen content of the sprayed deposit as compared to the oxygen content in the metal wire.

A process for reducing the oxygen content in metal articles formed by powder metal pressing (PMP is known to those skilled in the art. This process involves the addition of carbon to a metal powder prior to pressing. One drawback with this process ms the requirement of an additional step of annealing. After pressing the powder metal into a desired shape, the pressed metal article must be annealed to reduce the oxides. This additional step of annealing represents a waste of time, labor and resources.

It has been desirable to have a method of depositing high quality metal coatings by thermal spray methods which result in the metal coating having a lower oxygen level as compared to the metal powder being sprayed, without requiring the additional step of annealing. It has further been desirable to have a metal mixture which is thermally sprayable to form a metal coating having an ultra-low oxygen content without the requirement of annealing the deposited coating. It has still further been desirable to have a thermally sprayed metal coating having low oxygen content after thermal spray deposition without requiring additional annealing. It has yet further been desirable to achieve comparably low levels of oxygen in a resultant metal coating thermally sprayed using gas or water atomized metal powders, without employing the labor intensive additional step of annealing the metal coating deposited by thermal spray deposition.

When plasma spray techniques are used to deposit a metal coating, it has been particularly desirable to determine the best combination of plasma spray parameters such as primary gas flow rate, carrier gas flow rate, energy supplied to the plasma gun and the stand-off distance of the gun from the substrate, in order to optimize the reduction of oxygen content in the metal.

The present invention is directed to overcome one or more problems of heretofore utilized methods for reducing oxygen content in metal coatings which are deposited by plasma spray techniques.

DISCLOSURE OF THE INVENTION

In one aspect of the present invention, a method for reducing oxygen content in metal coatings deposited by plasma spray techniques is disclosed. The method comprises the following steps. A metal powder is provided. Carbon is adhered and coated to the metal powder and a carbon coated metal powder is formed. A primary gas is provided to a plasma spray gun. The primary gas is selected from one of nitrogen, argon, or helium. The primary gas is provided at a flow rate in the range of from about 30 liter/min to about 80 liter/min. A carrier gas is also provided to the plasma spray gun. The carrier gas is selected from one of nitrogen, argon, or helium. The carrier gas is provided at a flow rate in the range of from about 4 liter/min to about 8 liter/min. The carbon coated metal powder is provided to the plasma gun at a flow rate in the range of from about 30 gms/min to about 85 gms/min. The plasma spray gun is positioned at a stand-off distance in the range of from about 100 mm to about 175 mm from a substrate. The plasma spray gun is energized with power in the range of from about 28 kW to about 42 kW. The carbon coated metal powder is sprayed onto the substrate and a metal coating is deposited on the substrate. The metal coating has an oxygen content at least 20% by weight less than an oxygen content of the metal powder.

BEST MODE FOR CARRYING OUT THE INVENTION

The term "ultra-low oxygen content", as used herein to describe the oxygen content in the metal coating, means an oxygen content equal to or less than about 0.05% oxygen by weight.

The term "reducing oxygen content", as used in the specification and the claims, means reducing the final oxygen content in the metal coating deposited by thermal spray techniques, when compared to the initial oxygen content in the carbon coated metal powder before it is sprayed onto the metal substrate. In the present invention, the oxygen content in the metal coating is reduced due to the reduction reaction of the carbon coating on the metal powder with the oxygen present in the metal powder during the thermal spraying operation, and also due to the manipulation of the plasma spray parameters, to form carbon dioxide, carbon monoxide and/or mixtures thereof, without the aid of any additional steps such as annealing, to further reduce the metal coating.

The term "providing a metal powder", as used herein means providing any metal powder, such as for example AISI 4140 steel composition. The metal powder may or may not contain oxygen. For example, because of the partial oxidation of the metal powder, the powder may have some oxygen content. The oxygen may be present in the form of elemental oxygen or in the form of a metal oxide. It must be understood that it is not essential that the metal powder selected must contain oxygen, and it is anticipated that a selected metal powders may contain only trace amounts of oxygen, or no oxygen at all. Further, the metal powder provided may be a gas atomized metal powder or a water atomized metal powder. Still further, the metal powder provided may be annealed or unannealed.

The term "gas atomized metal powders" means metal powders produced by gas atomization techniques. Such techniques are well known to those skilled in the art of producing metal powders for thermal spray applications and such powders are commercially available. In gas atomized metal powders, the oxygen content in the metal powder is usually very low, in the range of 100 ppm to 2000 ppm, or 0.01% to 0.20% by weight respectively, for example. Such metal powders are quite suitable for carrying out the present invention. However, even though the oxygen content in these gas atomized powders is initially low, these powders get oxidized during the thermal spray process and consequently result in a high oxygen content in the metal coating. The present invention addresses this problem by reducing the oxygen content in the metal coating without utilizing any further annealing of the metal coating.

The term "water atomized metal powders" means metal powders produced by water atomization techniques. Such techniques are also well known to those skilled in the art of producing metal powders for thermal spray applications and such powders are also commercially available. In unannealed water atomized metal powders, the oxygen content in the metal powder is usually quite high, in the range of 10000 ppm to 15000 ppm, or 1.0% to 1.5% by weight respectively, for example. In such instances, the present invention is particularly useful in reducing the oxygen content during the thermal spraying operation, without the aid of additional annealing of the metal coating.

The term "adhering", as used herein, means coating the metal powder with carbon powder in a manner such that the carbon powder bonds to the metal powder particles and substantially encapsulates the metal powder particles. It must be understood that the carbon powder used in this invention, which has a particle size in the range of about 0.2 μm to about 2 μm, need not fully encapsulate the metal powder particles, which typically have a particle size in the range of about 10 μm to 500 μm. However, the carbon powder must substantially bond onto the metal particle surface and must not fall off the metal powder as the powder is thermally sprayed. Various methods for adhering carbon powder onto the metal powder are known to those skilled in the art and need not be discussed here in detail.

The term "plasma spray", as used herein means gas stabilized plasma spray techniques.

The term "annealed", as used herein, means the annealing process for reducing oxygen in metals at high temperature and under reducing atmosphere. This process is well known to those skilled in the art, and thus will not be discussed here.

In the preferred embodiment of the present invention, the method for reducing oxygen content in metal coatings deposited by plasma spray deposition techniques comprises the step of providing a metal powder. The metal powder has a particle size desirably in the range of from about 10 μm to about 500 μm. Preferably, the particle size is in the range of from about 75 μm to 350 μm and even more preferably, in the range of from about 100 μm to 300 μm. A particle size less than 10 μm and greater than about 500 μm is undesirable because it detrimentally effects the adherability of the carbon particles to the metal powder.

In the preferred embodiment, the oxygen content of the metal powder is desirably no greater than about 2% by weight of the metal powder. It is undesirable to provide a metal powder containing oxygen greater than about 2% because an excess amount of oxygen in the metal powder detrimentally affects the formability of the resultant coating. Preferably, the oxygen content in the metal powder is the range of from about 0.1% to about 2% by weight of metal powder and even more preferably, the oxygen content is in the range of from about 0.02% to about 0.5% by weight. Alternatively, one may provide a metal powder containing only trace amounts of oxygen, or even no oxygen. However, during plasma spray deposition, the metal particles in the flame will get oxidized. The present invention is beneficial in reducing the oxidation which occurs during plasma spray.

In the preferred embodiment, the metal powder is an annealed water atomized metal powder. Alternatively, one skilled in the art may use annealed or unannealed gas atomized powder, and/or annealed or unannealed water atomized metal powder. A water atomized metal powder which is annealed is desirable because it represents a savings of resources and material cost. It is known to one skilled in the art that water atomized metal powders contain about five to ten times greater oxygen than gas atomized metal powders but cost substantially less than gas atomized metal powders. The benefits of the present invention are particularly appreciable because this invention helps achieve comparably low levels of oxygen in the resultant metal coating deposited from either gas or water atomized metal powders without the additional labor intensive step of annealing the deposited metal coating after thermal spray deposition.

In the preferred embodiment of the present invention, the method further comprises the step of adhering and coating carbon to the metal powder. It is desirable and very important that the carbon be adhered to the metal powder, otherwise, a lowering of the oxygen content in the metal coating will not result.

In the preferred embodiment, the carbon is present in the range of from about 0.3% to about 2% by weight of the carbon coated metal powder. The term "carbon coated metal powder" as used herein means the carbon coated metal powder obtained from the step of adhering carbon to the metal powder. It is desirable that the carbon be present in an amount equal to or greater than about 0.3% by weight in order for the metal coating to have an oxygen content which is at least 20% by weight less than the oxygen content of the metal powder. It is also desirable that the carbon be present in an amount equal to or greater than about 0.4% by weight in order for the metal coating to have an oxygen content which is at least 30% by weight less than the oxygen content of the metal powder. It is undesirable to have carbon present in an amount greater than about 2% by weight because no further appreciable reduction in the oxygen content of the resultant metal coating is attained.

In the preferred embodiment, the carbon is in the form of a powder having a particle size in the range of from about 0.2 μm to about 2 μm. A particle size less than about 0.2 μm is undesirable because it is impractical to handle such a fine sized carbon powder. The particle size greater than about 2 μm is undesirable because it detrimentally affects the adherence and coat-ability of the carbon powder on the metal powder.

In the preferred embodiment of the present invention, a primary gas is desirably selected from one of nitrogen, argon, or helium, and is preferably nitrogen. Nitrogen is preferred because of ease of availability and relatively low price. The primary gas is provided to a plasma gun at a flow rate desirably in the range of from about 30 liter/min to about 80 liter/min, preferably in the range of from about 47 liter/min to about 54 liter/min, and most preferably, at about 50 liter/min. A primary gas flow rate less than about 30 liter/min or greater than about 80 liter/min is undesirable because the resultant metal coating will not have at least 20% lower oxygen content than the oxygen content in the metal powder.

In the preferred embodiment of the present invention, a carrier gas is desirably selected from one of nitrogen, argon, or helium, and is preferably nitrogen. The carrier gas is provided to the plasma gun at a flow rate desirably in the range of from about 4 liter/min to about 8 liter/min, preferably in #20 the range of from about 5 liter/min to about 7 liter/min, and most preferably, at about 5 liter/min. A carrier gas flow rate less than about 4 liter/min or greater than about 8 liter/min is undesirable because the resultant metal coating will not have at least 20% lower oxygen content than the oxygen content in the metal powder.

In the preferred embodiment of the present invention, the carbon coated metal powder is provided to the plasma gun at a flow rate desirably in the range of from about 30 gms/min to about 85 gms/min, preferably in the range of from about 45 gms/min to about 75 gms/min, and most preferably, at about 60 gms/min. A flow rate less than about 30 gms/min will result in too slow a deposition rate and a flow rate greater than about 85 gms/min will result in unmelted metal particles in the plasma flame and less than desired oxygen reduction, and consequently, detrimentally affect the coating quality.

In the preferred embodiment of the present invention, a plasma spray gun is positioned at a standoff distance desirably in the range of from about 100 mm to about 175 ram from the metal substrate, and preferably at about 125 mm. The term "standoff distance", as used herein, means the distance at which the plasma spray gun is spaced away from the substrate. It is undesirable to have a standoff distance less than about 100 mm because it may cause unmelted metal particles in the plasma flame and less than desired oxygen reduction, and hence detrimentally affect the coating quality. It is undesirable to have a standoff distance greater than about 175 mm because it reduces the deposition efficiency of the coating process. The term "deposition efficiency", as used herein, means the efficiency of coating deposition calculated by determining the fraction of the metal powder which is deposited as a metal coating as compared to the total amount of metal powder provided to the plasma spray gun. The deposition efficiency is thus expressed as a percentage of the metal powder deposited on the substrate as a metal coating.

In the preferred embodiment of the present invention, the gas stabilized plasma spray gun is energized with power no less than about 25 kW and preferably in the range of about 28 kW to 42 kW. It is undesirable to energize the plasma spray gun with less than about 25 kW because a reduction in the oxygen content of the metal coating by an amount of at least 20% by weight less than the oxygen content of the metal powder will not occur.

In the preferred embodiment of the present invention, the process of reducing oxygen content in metal coatings further comprises the step of plasma spraying the carbon coated metal powder onto a substrate and depositing a metal coating on the substrate. It is preferable to spray by gas stabilized plasma spray.

In the preferred embodiment of the present invention, the metal coating has an oxygen content that is desirably at least 20 % by weight less than the oxygen content of the metal powder, and preferably at least 30% by weight lower. It is desirable to reduce the oxygen content in the metal coating by at least 20% in order to improve the formability of the coating, to make the coating less brittle and to improve corrosion resistance. In the preferred embodiment, the metal coating has desirably less than 0.5% by weight, and preferably less than 0.1% by weight oxygen.

In the preferred embodiment, the carbon coated metal powder has a particle size in the range of from about 50 μm to about 300 μm. Desirably, the particle size is in the range of from about 100 μm to about 200 μm and preferably about 150 μm. A particle size less than about 50 μm is undesirable because the particles would be too small and would not flow too well in a plasma spray equipment, such as a conduit feeding the plasma spray powder mixture to a gun, for example. A particle size greater than about 300 μm is not desirable because the particles would be too large and would not be suitable for injection into a plasma flame, thus detrimentally affecting coating quality.

The following Examples are provided to further illustrate the preferred embodiments of the process of the present invention. In the following Examples, the oxygen content in the metal powder and in the metal coating was measured by ASTM Method E1019-88, using a commercially available equipment having a trade name "LECO".

EXAMPLE A

A water atomized and annealed metal powder manufactured by Hoeganaes Corporation under the trade name "Ancorsteel 4600", and having the following composition, by weight %, was provided:

| | |
|---|---|
| carbon | 0.05 |
| sulphur | 0.015 |
| oxygen | 0.15 |
| nitrogen | less than 0.001 |
| phosphorous | 0.006 |
| silicon | 0.005 |
| manganese | 0.17 |
| copper | 0.09 |
| nickel | 1.78 |
| molybdenum | 0.54 |
| chromium | 0.03 |
| iron | essentially balance. |

The above crystalline metal powder had a particle size in the range of 10 μm to 500 μm and a density of about 6.75 gms/cc. The Sieve Analysis in Mesh (U.S. std.) of the above powder was as follows: 100 Mesh–0 wt%, 140 Mesh (105 μm to 150 μm)–9.3 wt%, 200 Mesh (74 μm to 105 μm)–38.1 wt%, 230 Mesh (62 μm to 74 μm)–26.8 wt %, 325 Mesh (44 μm to 62 μm)–24.5 wt%, and PAN (less than 36 μm)–1.3 wt%. About 0.5% by weight amorphous carbon powder having a particle size in the range of 0.5 μm to 1μm and a density of about 2 gms/cc was adherently coated on this metal powder by a process, such as Hoeganaes Corporation's "Ancorbond™" bonding process, which is a commercial process.

The above carbon coated powder was then sprayed onto a steel substrate by gas stabilized plasma spray using a METCO™ 9MB plasma gun with a 7MC nozzle and a Metco No. 2 powder injection port injecting at 12 o'clock position into the flame. The power, primary and carrier gas flow rates and standoff distance were varied. The initial oxygen content in the metal powder was kept constant, at about 1500 ppm by weight, or 0.15% by weight of the powder. The metal powder was provided to the plasma gun at a constant feed rate of 60 gms/min.

The plasma spraying was done in an inert atmosphere chamber having an internal volume of about 30 cubic feet, with nitrogen gas being circulated through the chamber at a purge rate of about 10% of the chamber volume per minute.

The following results, as shown in Table I, were obtained.

TABLE I

| | | | | OXYGEN CONTENT, ppm | | |
|---|---|---|---|---|---|---|
| Primary Gas, 1 pm | Carrier Gas, 1 pm | Power, kW | Standoff, mm | Powder | Coating | Wt. % Reduc. |
| 40 | 7.3 | 35 | 125 | 1500 | 2860 | none |
| 40 | 5.1 | 42 | 125 | 1500 | 350 | 76.6 |
| 40 | 5.1 | 28 | 125 | 1500 | 145 | 90.3 |
| 50 | 7.3 | 42 | 125 | 1500 | 731 | 51.3 |
| 70 | 6.2 | 42 | 125 | 1500 | 466 | 68.9 |
| 50 | 5.1 | 35 | 125 | 1500 | 235 | 84.3 |
| 70 | 7.3 | 28 | 125 | 1500 | 1500 | none |
| 50 | 6.2 | 28 | 125 | 1500 | 486 | 67.6 |

EXAMPLE B

The same carbon coated metal powder as used in Example A was mixed with 50% by volume titanium carbide (TiC) powder. The above carbon coated powder was then sprayed onto a steel substrate by the same method as described in Example A. The following results, as shown in Table II, were obtained.

TABLE II

| | | | | OXYGEN CONTENT, ppm | | |
|---|---|---|---|---|---|---|
| Primary Gas, 1 pm | Carrier Gas, 1 pm | Power, kW | Standoff, mm | Powder | Coating | Wt. % Reduc. |
| 40 | 7.3 | 35 | 125 | 1500 | — | 13 |
| 40 | 5.1 | 42 | 125 | 1500 | 616 | 58.9 |
| 40 | 5.1 | 28 | 125 | 1500 | 902 | 39.9 |
| 50 | 7.3 | 42 | 125 | 1500 | 184 | 87.7 |
| 70 | 6.2 | 42 | 125 | 1500 | 459 | 69.4 |
| 50 | 5.1 | 35 | 125 | 1500 | 680 | 54.6 |
| 70 | 7.3 | 28 | 125 | 1500 | 1990 | none |
| 50 | 6.2 | 28 | 125 | 1500 | 743 | 50.5 |

As shown in Table I, it was observed that the oxygen reduction was the greatest when the gun was energized with 28 kW, the primary gas $N_2$ was provided at a flow rate of 40 liter/min, the carrier gas $N_2$ was provided at a flow rate of 5.1 liter/min, and the gun standoff distance was 125 mm. The above powder was thermally sprayed with a deposition efficiency of about 78%, and the oxygen content in the metal coating was 145 ppm, as compared to an oxygen content of 1500 ppm in the metal powder, i.e., a reduction of about 90%.

Industrial Applicability

The present invention is useful for depositing high quality metal coatings by plasma spray methods which result in the metal coating having a lower oxygen level as compared to the metal powder being sprayed, without requiring the step of annealing. The present invention is particularly useful in reducing the oxygen content in thermally sprayed metal coatings using water atomized metal powders as the starting material, by adherently coating the metal powder with carbon powder.

The benefits of the present invention are particularly appreciable considering the fact that commercially available gas atomized metal powders are about twice as expensive as water atomized metal powders and thus, the use of gas atomized metal powders represents a waste of labor and resources. However, water atomized metal powders contain about five to ten times greater oxygen than gas atomized metal powders. The present invention helps achieve comparably low levels of oxygen in the resultant metal coating deposited from gas or water atomized metal powders, without employing the labor intensive additional step of annealing the deposited metal coating after thermal spray deposition. Hence, the present invention represents a savings of materials, labor and resources.

The thermally sprayed metal coatings deposited by the process of the present invention are used in various engine components to alter the thermal conductivity and/or the wear characteristics of such components.

Other aspects, objects and advantages of this invention can be obtained from a study of the disclosure and the appended claims.

We claim:

1. A method for reducing oxygen content in metal coatings obtained from metal powders containing oxygen, and deposited by gas stabilized plasma spray techniques, comprising the steps of:

providing an oxygen containing metal powder, said metal powder having a particle size in the range of from about 10 μm to about 500 μm;

adhering and encapsulating carbon to said metal powder and forming a carbon coated metal powder;

providing a primary gas to a plasma spray gun, said primary gas being selected from one of nitrogen, argon, or helium, and said primary gas being provided at a flow rate in the range of from about 38 liter/min to about 68 liter/min;

providing a carrier gas to said plasma spray gun, said carrier gas being selected from one of nitrogen, argon, or helium, and said carrier gas being provided at a flow rate in the range of from about 5 liter/min to about 7 liter/min;

providing said carbon coated metal powder to said plasma gun at a flow rate in the range of from about 30 gms/min to about 85 gms/min;

positioning said plasma spray gun at a stand-off distance in the range of from about 100 mm to about 150 mm from a substrate;

energizing said plasma spray gun with power in the range of from about 28 kW to about 42 kW; and plasma spraying said carbon coated metal powder onto said substrate and depositing a metal coating on said substrate, said coating having an oxygen content at least 20% by weight less than an oxygen content of said metal powder.

2. A method, as set forth in claim 1, wherein said primary gas is provided at a flow rate in the range of from about 47 liter/min to about 54 liter/min.

3. A method, as set forth in claim 2, wherein said primary gas is provided at a flow rate of about 50 liter/min.

4. A method, as set forth in claim 1, wherein said carrier gas is provided at a flow rate of about 5 liter/min.

5. A method, as set forth in claim 4, wherein said carbon coated metal powder is provided at a flow rate in the range of from about 45 gms/hour to about 75 gms/min.

6. A method, as set forth in claim 5, wherein said carbon coated metal powder is provided at a flow rate of about 60 gms/min.

7. A method, as set forth in claim 1, wherein said plasma spray gun is positioned at a stand-off distance of about 125 mm.

8. A method, as set forth in claim 1, wherein said plasma spray gun is energized with power in the range of from about 30 kW to about 40 kW.

9. A method, as set forth in claim 8, wherein said plasma spray gun is energized with power of about 34 kW.

10. A method, as set forth in claim 1, wherein said metal powder has an oxygen content no greater than about 2.0% by weight.

11. A method, as set forth in claim 1, wherein said carbon is present in the range of from about 0.3% to about 2.0% by weight of said carbon coated metal powder.

12. A method, as set forth in claim 11, wherein said carbon is in the form of a powder having a particle size in the range of from about 0.2 μm to about 2.0 μm.

13. A method, as set forth in claim 1, wherein said metal coating has an oxygen content at least 30% by weight less than an oxygen content of said metal powder.

14. A method, as set forth in claim 13, wherein said carbon is present in the range of from about 0.4% to about 2.0% by weight of said carbon coated metal powder.

15. A method, as set forth in claim 1, wherein said oxygen content of said metal coating is less than 0.5% by weight of said metal coating.

16. A method, as set forth in claim 15, wherein said oxygen content of said metal coating is less than 0.1% by weight.

17. A method, as set forth in claim 1, wherein said carbon coated metal powder has a particle size in the range of from about 50 μm to about 300 μm.

* * * * *